US006074275A

United States Patent [19]

Yashiki et al.

[11] Patent Number: 6,074,275

[45] Date of Patent: Jun. 13, 2000

[54] POLISHING SYSTEM AND METHOD OF CONTROL OF SAME

[75] Inventors: Hiroshi Yashiki; Kouji Ishibashi, both of Ayase, Japan

[73] Assignee: Speedfam-IPEC, Corporation, Ayase, Japan

[21] Appl. No.: 09/135,847

[22] Filed: Aug. 18, 1998

[30] Foreign Application Priority Data

Oct. 7, 1997 [JP] Japan ..... 9-290278

[51] Int. Cl.[7] ..... B24B 49/00

[52] U.S. Cl. ..... 451/5; 451/9; 451/288; 451/268; 451/332; 451/270

[58] Field of Search ..... 451/9.5, 10, 11, 451/41, 285, 287, 288, 266, 268, 269, 332, 270, 271

[56] References Cited

U.S. PATENT DOCUMENTS 5,140,774 8/1992 Onodera .
5,733,171 3/1998 Allen et al. .
5,823,854 10/1998 Chen .

*Primary Examiner*—Timothy V. Eley
*Assistant Examiner*—Willie Berry, Jr.
*Attorney, Agent, or Firm*—Fitch, Even, Tabin & Flannery

[57] ABSTRACT

A polishing system and a method of control of the same enabling reliable transfer of the workpieces into and out of the system while maintaining the precision of polishing of the workpieces. Provision is made of a polishing apparatus 1, a first transfer apparatus 2, a second transfer apparatus 3, and a control apparatus 4. In the polishing apparatus 1, workpieces W held in m number of holding holes 14 formed in n number of carriers 14 are polished on their two surfaces by a lower platen 10 and an upper platen 19. The control apparatus 4 finds the revolution angle of the carriers 14 when the workpieces reach the desired thickness, makes the carriers revolve until the revolution angle of a whole multiple of 360°/n closest to the revolution angle found, and then makes the polishing apparatus 1 stop. Further, it finds the rotation angle of the carriers after stopping and makes mounters 24 and 34 of a loader 23 and unloader 33 rotate by exactly that rotation angle so as to transfer the workpieces W into and out from the carriers 14.

21 Claims, 10 Drawing Sheets

POLISHING SYSTEM AND METHOD OF CONTROL OF SAME

BACKGROUND OF THE INVENTION

1. Field of the Invention

The present invention relates to a polishing system which automatically transfers in, polishes, and transfers out magnetic disks or other workpieces.

2. Description of the Related Art

As this type of polishing system, there is, for example, the related art shown in FIG. 10.

In FIG. 10, reference numeral 110 is a first transfer unit for transferring the unpolished workpieces W in, reference numeral 120 is a polishing unit for polishing the transferred workpieces W to a predetermined thickness, and reference numeral 130 is a second transfer unit for transferring the workpieces W polished at the polishing unit 120 out.

The first transfer unit 110 picks up workpieces W arranged on a table 111 by chucks 113 fixed to a loader 112, moves the loader 112 along a rail 140 then transfers the workpieces to holding holes 121*a* of carriers 121 of the polishing unit 120.

The polishing unit 120 grips the workpieces W held in the carriers 121 between a lower plate 122 and an upper plate 123, drives a sun gear 124 to rotate, and makes the upper and lower platens 122 and 123 rotate in mutually opposite directions so as to polish the two surfaces of the workpieces W.

That is, by driving the sun gear 124 to rotate, the carriers 121 rotate and revolve in the donut-shaped shape between the sun gear 124 and an internal gear 125, so the workpieces W in the carriers 121 are effectively polished by the oppositely rotating lower platen 122 and upper platen 123. The polishing work is stopped when the workpieces W are polished to the desired thickness.

The second transfer unit 130 moves an unloader 131 along the rail 140 to the polishing unit 120 side, takes out the polished workpieces W from the holding holes 121*a* of the carriers 121 by chucks 132 fixed to the unloader 131, then carries the workpieces to a table 133 and arranges them there.

In order for the loader 112 of the first transfer unit 110 to reliably transfer the unpolished workpieces W into the holding holes 121*a* of the carriers 121 and for the unloader 131 of the second transfer unit 130 to reliably transfer the polished workpieces W from the holding holes 121 a of the carriers 121, however, it is necessary that the carriers 121 and the holding holes 121*a* be returned to the positions at the time of start of the polishing when the polishing is finished.

FIGS. 11A and 11B are schematic plan views for explaining the positions of the carriers and holding holes. FIG. 11A shows the positions at the time of start of the polishing, while FIG. 11B shows the positions at the end of the polishing.

As shown in FIG. 11A, if the polishing is started when the centers of the three carriers 121-1 to 121-3 and the centers of the holding holes 121*a* lie on three straight lines m 120 degrees apart, when the polishing is ended, if the centers of the three carriers 121-1 to 121-3 are off from the lines m as shown by the broken lines in FIG. 11B or if the centers of the carriers 121-1 to 121-3 are aligned with the lines m but the centers of the holding holes 121*a* are not on the lines m as shown by the solid lines, the chucks 113 and 132 fixed to the loader 112 and unloader 131 will not be able to transfer the workpieces W into and out from the holding holes 121*a* of the carriers 121.

Accordingly, when ending the polishing, it is also necessary that the centers of the carriers 121 and the centers of the holding holes 121*a* be positioned on the lines m.

Therefore, this polishing system is designed to set the gear ratio among the sun gear 124, the internal gear 125, and the carriers 121 to 1:3:1 so that when the sun gear 124 rotates by exactly a whole multiple of 4, the carriers 121 will return to their positions at the start of revolution and the holding holes 121*a* of the carriers 121 will return to their positions at the start of their rotation.

That is, the system is designed so that when the sun gear 124 rotates by exactly a whole multiple of 4 from the state shown in FIG. 11A, the system will return to the start where the centers of the carriers 121-1 to 121-3 lie on the three straight lines m and the holding holes 121*a* of the carriers 121 lie on the lines m (hereinafter referred to as the "predetermined position state"). This makes it possible for the workpieces W to be reliably transferred into or transferred out of the holding holes 121*a* of the carriers 121 by the loader 112 or the unloader 131.

In the above polishing system of the related art, however, there were the following problems.

For example, when polishing workpieces W from the state shown in FIG. 11A and stopping the drive of the polishing unit 120 when the workpieces W are polished to a desired thickness, the carriers 121 and holding holes 121*a* will almost never end up in the above predetermined position state in practice.

Therefore, in the polishing system of the related art, it was necessary to rotate the sun gear 124 several times after the workpieces W were polished to the desired thickness so as to return the carriers 121 and the holding holes 121*a* to the predetermined position state.

Even if the sun gear 124 is rotated just once, however, the carriers 121 will rotate and revolve a considerable number of times. During that time, the workpieces W will end up being polished more than necessary.

In particular, when the carriers 121 or the holding holes 121*a* are slightly off from the predetermined position state, despite the workpieces W being the desired thickness, the sun gear 124 must be rotated as much as about 4 times in order to return the carriers 121 and the holding holes 121*a* to the predetermined position state. The loss in the workpieces W ends up becoming remarkably great in such a case.

In this way, in the polishing system of the related art, it was necessary to sacrifice some of the polishing precision of the workpieces W in order to reliably transfer the workpieces W in and out. In particular, this problem was conspicuous with a polishing unit 120 with a high polishing rate.

SUMMARY OF THE INVENTION

The present invention was made so as to solve the above problems and has as its object to provide a polishing system, and a method for control of the same, which enables reliable transfer of workpieces in and out of the system while maintaining the polishing precision of the workpieces.

To achieve this object, the polishing system according to a first aspect of the invention set forth in claim 1 comprises a polishing unit having a rotatable lower platen, a sun gear able to rotate about a center of the lower platen, a rotatable internal gear arranged concentrically at the outside of the sun gear, n number of carriers having around the centers thereof m number of holding holes formed at 360°/m intervals and arranged around the center of the sun gear at 360°/n intervals in a state engaged with the sun gear and internal gear, and an upper platen able to rotate in an opposite direction to the lower platen in a state gripping the workpieces in the holding holes of the carriers together with the lower platen; a first transfer unit having a loader movable to the polishing unit side, n number of mounters provided on the loader in an array corresponding to the n number of carriers and able to rotate, m number of chucks mounted on the mounters in an array corresponding to the m number of holding holes, and a rotating mechanism provided on the loader and enabling the n number of mounters to rotate all together, the first transfer unit picking up the unpolished workpieces by the chucks and transferring them into the holding holes formed in the carriers of the polishing unit; a second transfer unit having an unloader movable from the polishing unit side, n number of mounters provided on the unloader in an array corresponding to the n number of carriers and able to rotate, m number of chucks mounted on the mounters in an array corresponding to the m number of holding holes, and a rotating mechanism provided on the unloader and enabling the n number of mounters to rotate all together, the second transfer unit taking out the polished workpieces by the chucks from the holding holes of the carriers and transferring them to a predetermined location; and a control unit making the carriers revolve to a revolution angle of a whole multiple of 360°/n closest to a revolution angle of the carriers and stopping the polishing unit at the time when the workpieces become the desired thickness, finding a rotation angle of the carriers at the stopped position, and controlling the rotating mechanisms of the loader and unloader to make the mounters of the loader and unloader rotate by exactly that rotation angle.

According to this configuration, in the polishing unit, when at least one of the sun gear and the internal gear is made to rotate and the upper and lower platen are made to rotate in mutually opposite directions, the n number of carriers arranged at the 360°/n intervals rotate and revolve and the two surfaces of the n×m number of workpieces held in the m number of holding holes formed around the centers of the carriers at 360°/m intervals are simultaneously polished. When the workpieces reach the desired thickness, in the control unit, control is performed to make the carriers revolve to a revolution angle of a whole multiple of 360°/n closest to the revolution angle of the carriers at that time and stop. Suitably thereafter, the rotation angle of the carriers at the stopped position is found and the n number of mounters provided on the unloader of the second transfer unit are made to rotate by exactly that rotation angle. Due to this, the m number of chucks mounted on the mounters are positioned matching the positions of the polished workpieces, and the workpieces are taken out from the holding holes by the chucks and transferred out to a predetermined location. Further, the n number of mounters provided on the loader of the first transfer unit are also rotated by exactly the rotation angle of the carriers, the m number of chucks mounted on the mounters are positioned matching the holding holes of the carriers, and unpolished workpieces held up by the chucks are transferred into the empty holding holes.

Further, according to the polishing system in claim 2, the polishing system set forth in claim 1 is configured so that when the rotation angles of the sun gear and internal gear are A and B and the numbers of teeth of the sun gear, internal gear, and carriers are Zs, Zin, and Zc, based on the two equations $R=(A\cdot Zs+B\cdot Zin)/2(Zs+Zc)$ and $r=(R-A)\cdot Zs/Zc$, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

Due to the above configuration, in the control unit, when the workpieces reach the desired thickness, the carriers are made to revolve and stop at an angle of a whole multiple of 360°/n closest to the revolution angle R at that time. Further, the rotation angle r of the carriers at that time is calculated by a later indicated equation and the mounters of the loader and unloader rotate by exactly that rotation angle r.

There are, however, diverse modes of polishing at the polishing unit, such as polishing the workpieces in a state where just the internal gear is stopped. Therefore, the polishing system according to the invention in claim 3 comprises the polishing system as set forth in claim 2, wherein the polishing unit makes the sun gear rotate in a state where the internal gear is stopped and, based on the two equations $R=A\cdot Zs/2(Zs+Zc)$ and $r=(R-A)\cdot Zs/Zc$, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

Further, the polishing system according to the invention in claim 4 comprises the polishing system as set forth in claim 2, wherein the polishing unit makes the internal gear rotate in a state where the sun gear is stopped and, based on the two equations $R=B\cdot Zin/2(Zs+Zc)$ and $r=R\cdot Zs/Zc$, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

Further, the polishing system according to the invention in claim 5 comprises the polishing system as set forth in claim 2, wherein the polishing unit makes the sun gear and the internal gear rotate so that the carriers rotate to a predetermined position and, based on the two equations $0=(A\cdot Zs+B\cdot Zin)/2(Zs+Zc)$ and $r=A\cdot Zs/Zc$, the control unit calculates the rotation angle r of the carriers at a predetermined position and makes the mounters of the loader and unloader rotate by exactly the calculated rotation angle r of the carriers.

Further, the polishing system according to the invention in claim 6 comprises the polishing system as set forth in claim 2, wherein the polishing unit makes the sun gear and the internal gear rotate so that the revolution direction of the carriers becomes the same direction as the rotation direction of the sun gear and, under the condition $R>0$ and based on the two equations, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

Further, the polishing system according to the invention in claim 5 comprises the polishing system as set forth in claim 2, wherein the polishing unit makes the sun gear and the internal gear rotate so that the carriers rotate to a predetermined position and, based on the two equations $0=(A\cdot Zs+$ B·Zin)/2(Zs+Zc) and r=A·Zs/Zc, the control unit calculates the rotation angle r of the carriers at a predetermined position and makes the mounters of the loader and unloader rotate by exactly the calculated rotation angle r of the carriers.

Further, the polishing system according to the invention in claim 7 comprises the polishing system as set forth in claim 2, wherein the polishing unit makes the sun gear and the internal gear rotate so that the revolution direction of the carriers becomes the opposite direction as the rotation direction of the sun gear and, under the condition R<0 and based on the two equations, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

Further, the rotating mechanisms of the first transfer unit and the second transfer unit need only be able to make the n number of mounters rotate all together. As an example of this, the polishing system according to the invention in claim 8 comprises the polishing system as set forth in claim 1, wherein the rotating mechanisms of the loader and unloader are comprised of gear mechanisms.

In particular, the polishing system according to the invention in claim 9 comprises the polishing system as set forth in claim 8, wherein each of the gear mechanisms is comprised of a first gear unit provided at each of the n number of mounters, a second gear unit for making the first gear units rotate all together, and a drive unit for making the second gear unit rotate and wherein the control unit controls the drive unit to make the n number of mounters rotate by exactly the rotation angle of the carriers; the polishing system according to the invention in claim 10 comprises the polishing system as set forth in claim 9, wherein the second gear unit is made to engage with all of the n number of first gear units; the polishing system according to the invention in claim 11 comprises the polishing system as set forth in claim 9, wherein an idle gear is interposed between the n number of first gear units and the second gear unit; and the polishing system according to the invention in claim 12 comprises the polishing system as set forth in claim 9, wherein an endless chain is wound between each of the n number of first gear units and the second gear unit.

Further, the polishing system according to the invention in claim 13 comprises the polishing system as set forth in claim 1, wherein the rotating mechanisms of the loader and the unloader are comprised of belt mechanisms. In particular, the polishing system according to the invention in claim 14 comprises the polishing system as set forth in claim 13, wherein each of the belt mechanisms winds an endless belt between each of the shafts of the n number of mounters and a shaft of the drive unit and the control unit controls the drive unit to make the n number of mounters rotate by exactly the rotation angle of the carriers.

To solve the above problems, further, the method of control of the polishing system according to a second aspect of the invention in claim 15 comprises a polishing step for making at least one of a sun gear and an internal gear rotate, making n number of carriers arranged around the center of the sun gear at 360°/n intervals revolve while rotating in a state where the sun gear and the internal gear are engaged, and polishing the two surfaces of workpieces held in m number of holding holes formed around the centers of the carriers at 360°/m intervals by an upper platen and lower platen rotating in mutually opposite directions; a carrier revolution angle adjustment step for making the carriers revolve until a revolution angle of a whole multiple of 360°/n closest to a revolution angle of the carriers when the workpieces reach a desired thickness, then making the rotation and revolution operation of the carriers stop; a carrier rotation determination step for finding a rotation angle of the carriers at the stopped position; a second transfer step for making n number of mounters provided on an unloader in an array corresponding to the n number of carriers, able to rotate, and having m number of chucks mounted on the mounters in an array corresponding to the m number of holding holes rotate by exactly the rotation angle of the carriers found in the carrier rotation angle determination step so that the chucks are positioned substantially matching the positions of the polished workpieces, holding the polished workpieces by these chucks, and transferring them out from the carriers; and a first transfer step for making n number of mounters provided on a loader in an array corresponding to the n number of carriers, able to rotate, and having m number of chucks mounted on the mounters in an array corresponding to the m number of holding holes rotate by exactly the rotation angle of the carriers found in the carrier rotation angle determination step so that the chucks are positioned substantially matching the positions of the polished workpieces, and transferring unpolished workpieces held by these chucks into the holding holes.

Further, the method of control of a polishing system of claim 16 comprises the method of control of a polishing system as set forth in claim 15, wherein the carrier revolution adjustment step and the carrier rotation angle determination step calculate a revolution angle R and a rotation angle r of the carriers at the stopped position from the two equations R=(A·Zs+B·Zin)/2(Zs+Zc) and r=(R−A)·Zs/Zc where the rotation angles of the sun gear and internal gear are A and B and the numbers of teeth of the sun gear, internal gear, and carriers are Zs, Zin, and Zc.

As examples of this, the method of control of a polishing system of claim 17 comprises the method of control of a polishing system as set forth in claim 16, wherein the polishing step makes the sun gear rotate in a state where the internal gear is stopped and the carrier revolution adjustment step and the carrier rotation determination step calculate a revolution angle R and a rotation angle r of the carriers at the stopped position based on the two equations R=A·Zs/2(Zs+Zc) and r=(R−A)·Zs/Zc; the method of control of a polishing system of claim 18 comprises the method of control of a polishing system as set forth in claim 16, wherein the polishing step makes the internal gear rotate in a state where the sun gear is stopped and the carrier revolution adjustment step and the carrier rotation determination step calculate a revolution angle R and a rotation angle r of the carriers at the stopped position based on the two equations R=B·Zin/2(Zs+Zc) and r=R·Zs/Zc; the method of control of a polishing system of claim 19 comprises the method of control of a polishing system as set forth in claim 16, wherein the polishing step makes the sun gear and the internal gear rotate so that the carriers rotate to a predetermined position and the carrier rotation determination step calculate a rotation angle r of the carriers at the stopped position based on the two equations 0=(A·Zs+B·Zin)/2(Zs+Zc) and r=A·Zs/Zc; the method of control of a polishing system of claim 20 comprises the method of control of a polishing system as set forth in claim 16, wherein the polishing step makes the sun gear and the internal gear rotate so that the revolution direction of the carriers becomes the same direction as the rotation direction of the sun gear and the carrier revolution adjustment step and the carrier rotation determination step calculate a revolution angle R and a rotation angle r of the carriers at the stopped position based on the two equations under the condition of R>0; and the method of control of a polishing system of claim 21 comprises the method of control of a polishing system as set forth in claim 16, wherein the polishing step makes the sun gear and the internal gear rotate so that the revolution direction of the carriers becomes the opposite direction as the rotation direction of the sun gear and the carrier revolution adjustment step and the carrier rotation determination step calculate a revolution angle R and a rotation angle r of the carriers at the stopped position based on the two equations under the condition of R>0.

BRIEF DESCRIPTION OF THE DRAWINGS

The above and other objects, features, and advantages of the present invention will become more readily apparent from the following detailed description of a presently preferred embodiment of the invention taken in conjunction with the accompanying drawings, in which.

DESCRIPTION OF THE PREFERRED EMBODIMENTS

An embodiment of the invention will be explained next with reference to the drawings.

Figure 1:
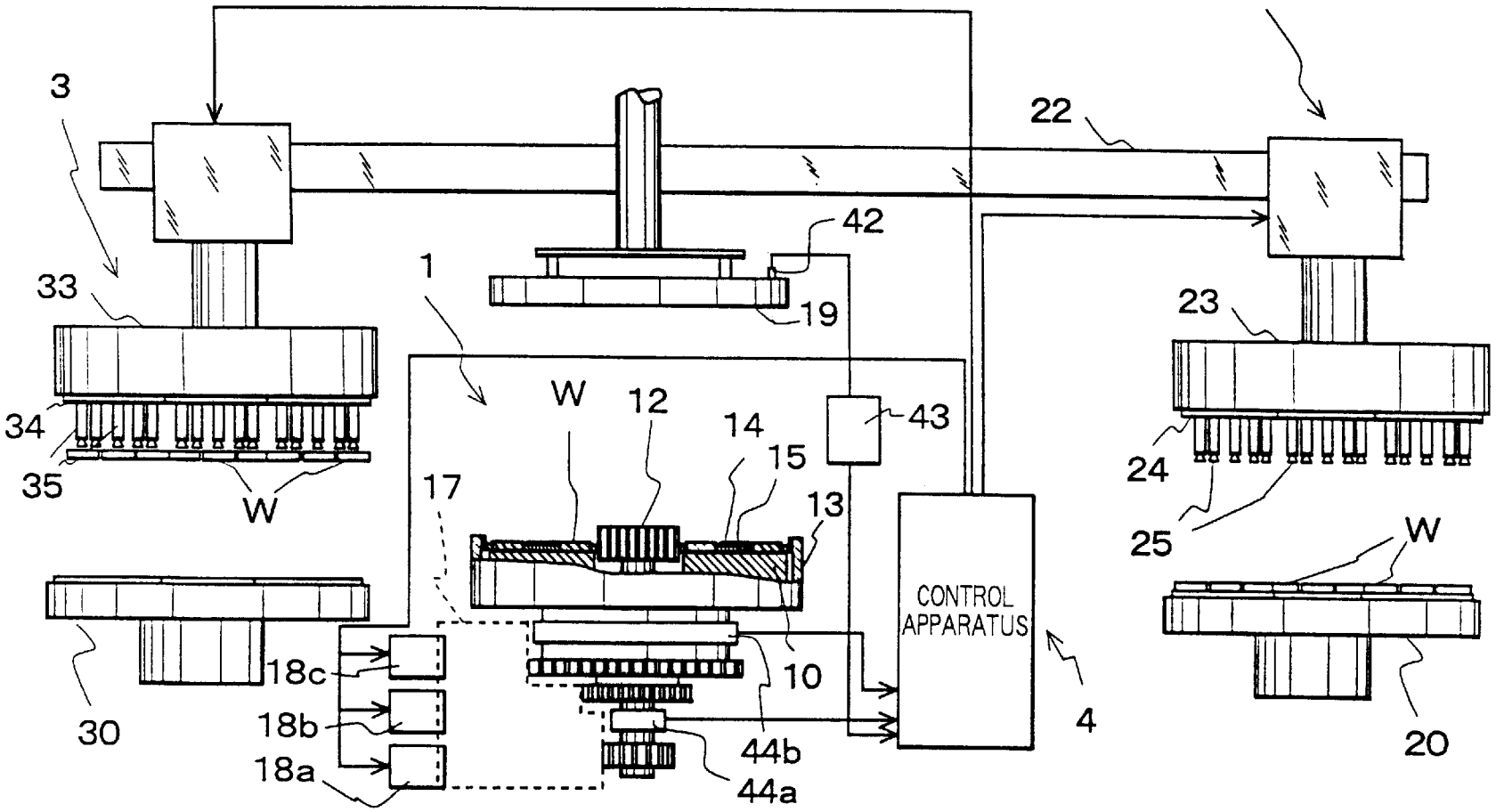
FIG. 1 is a schematic front view of a polishing system according to a first embodiment of the present invention.

FIG. 1 is a schematic front view of a polishing system according to a first embodiment of the present invention.

As shown in FIG. 1, the polishing system is comprised of a polishing apparatus 1 (polishing unit), a first transfer apparatus 2 (first transfer unit), a second transfer apparatus 3 (second transfer unit), and a control apparatus 4 (control unit).

The polishing apparatus 1 is a two-side lapping machine for polishing the two surfaces of workpieces W by a lower platen 10 and an upper platen 19 rotating in mutually opposite directions.

Figure 2:
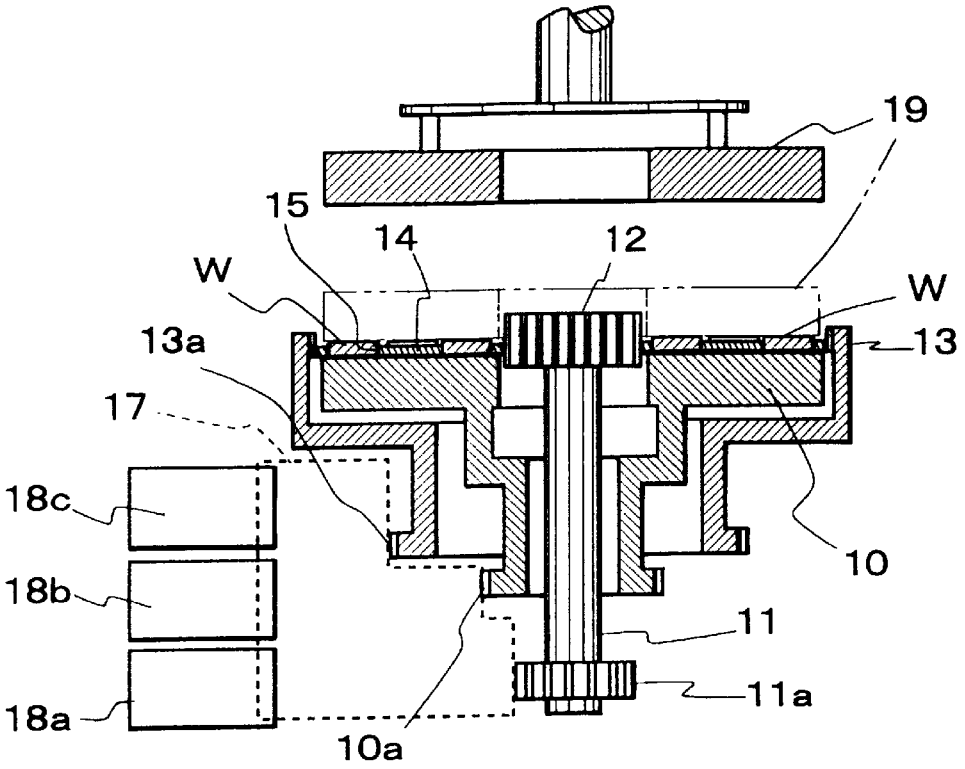
FIG. 2 is a sectional view of a polishing apparatus.

FIG. 2 is a sectional view of the polishing apparatus 1.

The lower platen 10 of the polishing apparatus 1 is supported so as to be able to rotate about a shaft 11. A sun gear 12 is affixed to the center portion of the lower platen 10, that is, the end of the shaft 11. Further, an internal gear 13 arranged concentrically with the lower platen 10 and the sun gear 12 is rotatably supported.

Gears 10*a*, 11*a*, and 13*a* are provided under the lower platen 10, the sun gear 12, and the internal gear 13. By driving motors 18*a*, 18*b*, and 18*c* through gear mechanisms 17, not shown, engaged with these gears 10*a*, 11*a*, and 13*a*, the sun gear 12, lower platen 10, and internal gear 13 can be made to rotate independently.

On the top surface of the lower platen 10 are placed n (n is a positive integer) number of carriers 14 in a state engaged with the sun gear 12 and the internal gear 13.

Figure 3:
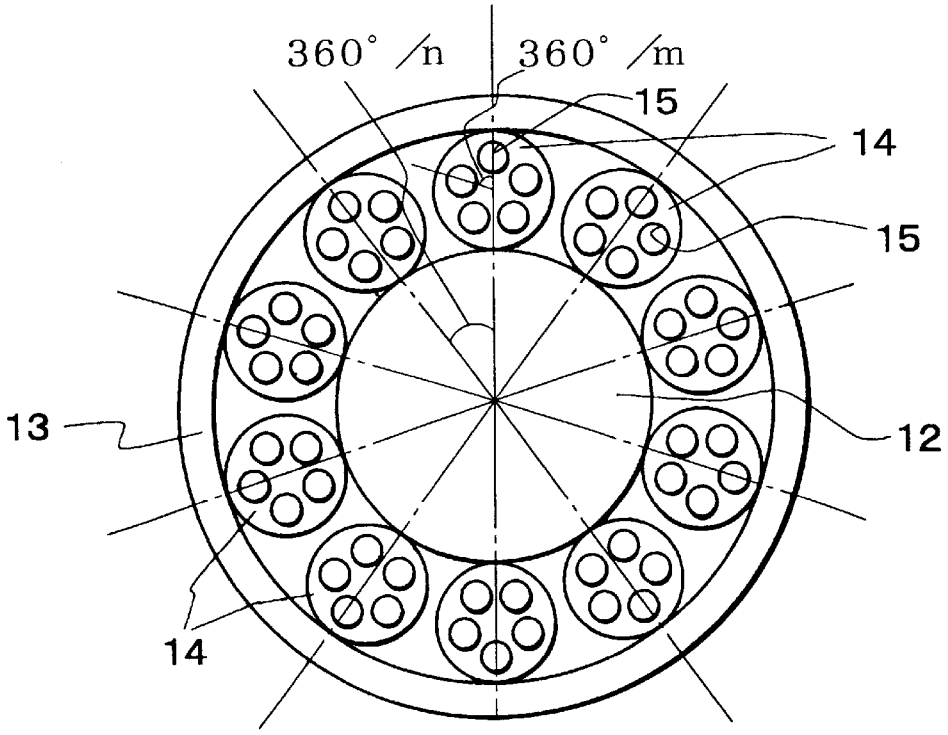
FIG. 3 is a schematic plan view of the array of n number of carriers.

FIG. 3 is a schematic plan view of the array of the n number of carriers 14.

As shown in FIG. 3, the n number of carriers 14 are arranged around the center of the sun gear 12 at 360°/n intervals. These carriers 14 are formed with m (m is a positive integer) number of holding holes 15 for holding the workpieces W around the centers of the carriers 14 at 360°/m intervals.

On the other hand, in FIG. 2, the upper platen 19 is suspended from above directly above the lower platen 10. It descends to grip the workpieces with the lower platen 10.

Due to this, by making the upper platen 19 and the lower platen 10 rotate in mutually opposite directions and driving at least one of the sun gear 12 and the internal gear 13 to rotate, the carriers 14 will rotate and revolve around the sun gear 12 and m x n number of workpieces W housed in the holding holes 15 of the carriers 14 will be polished at one time.

The apparatus for transferring the unpolished workpieces W to this polishing apparatus 1 is the first transfer apparatus 2 shown in FIG. 1.

The first transfer apparatus 2 is comprised of a table 20 on which the unpolished workpieces W are arranged and a loader 23 which slides along a rail 22 and loads the workpieces W on the table 20 in the polishing apparatus 1.

Figure 4:
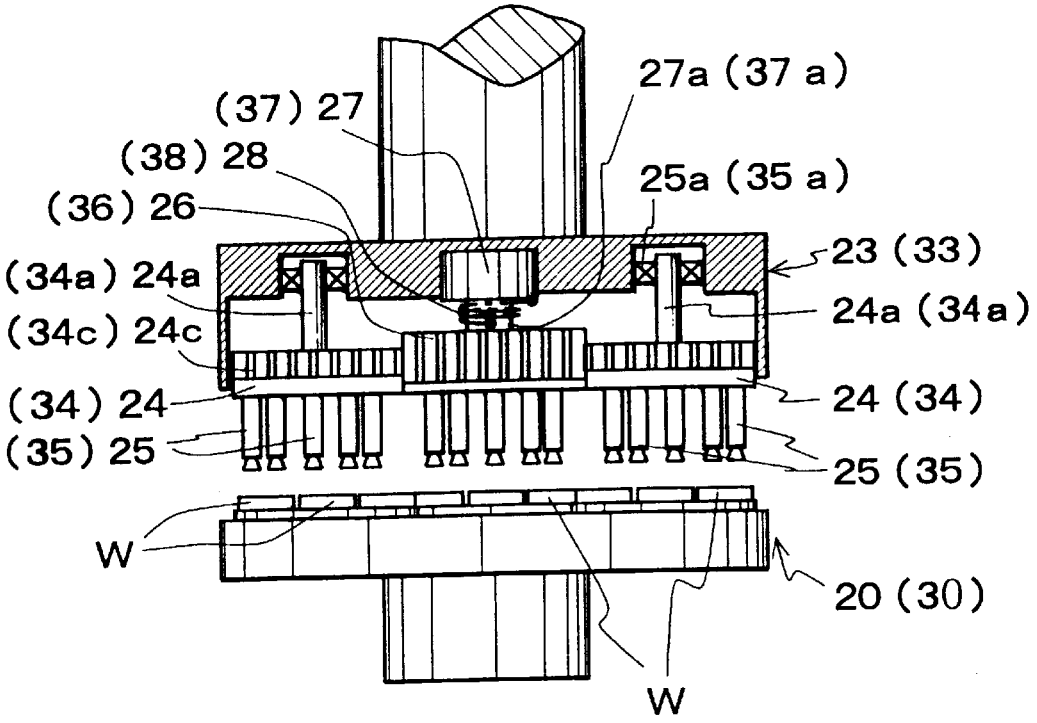
FIG. 4 is a sectional view of the table, loader, and unloader of a first transfer apparatus and second transfer apparatus.
Figure 5:
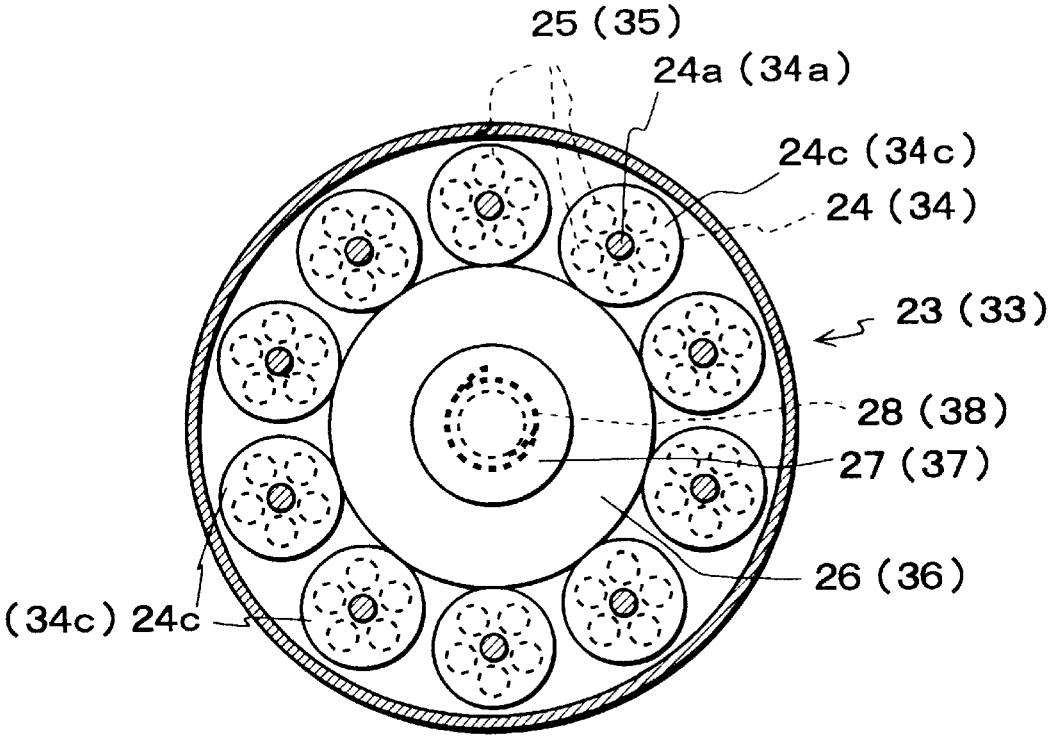
FIG. 5 is a schematic view of the structure of the loader and unloader.
Figure 6:
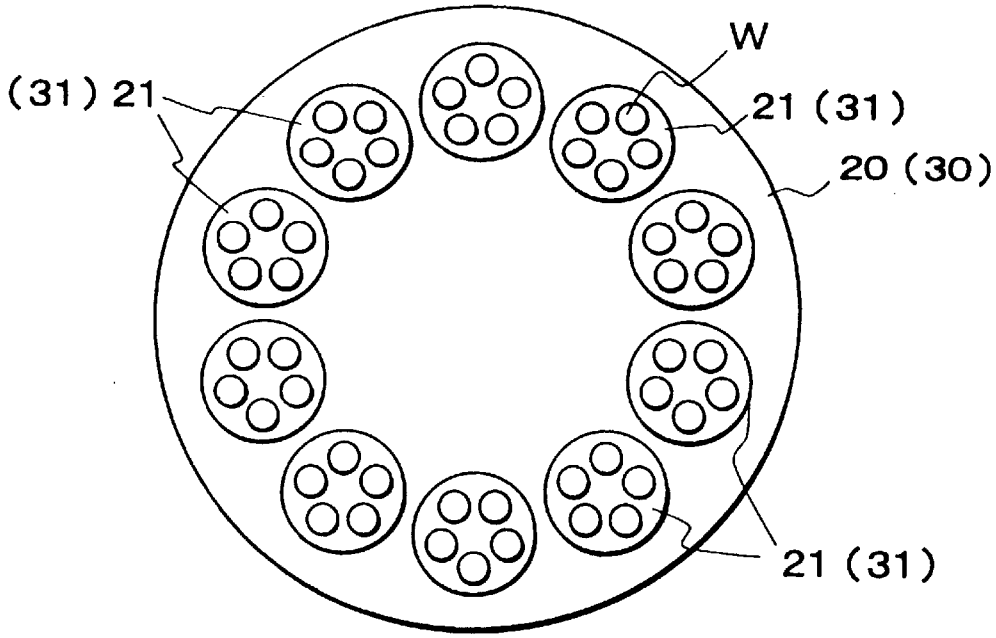
FIG. 6 is a plan view of the table.

FIG. 4 is a sectional view of the table 20 and loader 23 of the first transfer apparatus 2; FIG. 5 is a schematic view of the structure of the loader 23; and FIG. 6 is a plan view of the table 20.

As shown in FIG. 4, the loader 23 is designed to be able to ascend and descend with respect to the table 20 at a position directly above the table 20. At its lower surface are provided n number of mounters 24.

The n number of mounters 24, as shown in FIG. 5, are provided in an array corresponding to the array of carriers 14 of the polishing apparatus 1 (see FIG. 3). The shafts 24*a* of the mounters 24, as shown in FIG. 4, are supported by bearings 24*b* fixed to the loader 23.

Further, at the bottom surfaces of the mounters 24 are attached m number of chucks 25 for holding the workpieces W in an array corresponding to the holding holes 15 of the carriers 14.

That is, the n number of mounters 24 are arranged around the center of the loader 23 at 360°/n intervals, while the m number of chucks 25 are mounted around the centers of the mounters 24 at 360°m intervals.

These n number of mounters 24 are designed to be able to be rotated all together by a rotating mechanism.

Specifically, the rotating mechanism is a gear mechanism. As shown in FIG. 4 and FIG. 5, this is comprised of a first gear unit 24*c* provided at the top portion of each of the mounters 24 and a second gear unit 26 provided at the center of the n number of mounters 24 and engaging with all of the gear units 24*c*. By making the shaft 27*a* connected to the gear unit 26 rotate by the motor 27 (drive unit), the n number of mounters 24 are rotated all together.

Further, a spring 28 is wound around the shaft 27*a* of the motor 27. One end of the spring 28 is fixed to the motor 27, while the other end is fixed to the shaft 27*a*. Due to this, when the motor 27 makes the shaft 27*a* rotate, the spring 28 is compressed, while when the drive force of the motor 27 is disengaged, the shaft 27*a* rotates in reverse to its original position due to the recovery force of the spring 28. That is, the mounters 24 made to rotate by a predetermined angle due to the drive force of the motor 27 are designed to be reset by the recovery force of the spring 28 when the drive force of the motor 27 is disengaged.

On the other hand, the table 20, as shown in FIG. 6, has n number of receivers 21 on its top surface.

These receivers 21 are arranged corresponding to the mounters 24. The m number of unpolished workpieces W are placed on the receivers 21 by a not shown robot.

The workpieces W are placed in the receivers 21 in a manner corresponding to the mounting state of the chucks 25. Due to this, when the loader 23 directly above them is made to descend, the chucks 25 of the mounters 24 and the workpieces W of the receivers 21 match completely.

Accordingly, by making the loader 23 descend, it is possible to pick up all of the workpieces W on the table 20 by the chucks 25, then move the loader 23 along the rail 22 shown in FIG. 1 to the polishing apparatus 1.

The workpieces W polished at the polishing apparatus 1 are transferred out by the second transfer apparatus 3.

The second transfer apparatus 3 has a similar structure to the first transfer apparatus 2.

That is, as shown in FIG. 6, it is provided with a table 30 having n number of receivers 31 arranged at 360°/n intervals and an unloader 33 having at 360°/n intervals n number of mounters 34 to which m number of chucks 35 are mounted at 360°/m intervals. In the same way as the loader 23, the unloader 33 has a rotating mechanism in which a second gear unit 36 is engaged with first gear units 34*c* of the mounters 34 with shafts 34*a* axially supported by bearings 34*b*. By making the shaft 37*a* connected to the gear unit 36 rotate by the motor 37 (drive unit), it is possible to make the n number of mounters 34 rotate all together. The mechanism is designed to be reset by the recovery force of the spring 38 when the drive force of the motor 37 is disengaged.

Due to this, the unloader 33 takes out all of the polished workpieces W from the polishing apparatus 1, slides to the table 30 side, descends toward the table 30 at a position directly above the table 30, and places the held workpieces W on the receivers 31. The workpieces W placed on the receivers 31 are taken out by a not shown robot and stored in cassettes etc.

The polishing operation of the above polishing apparatus 1, the workpiece W transfer operation of the first transfer apparatus 2, the transfer operation of the second transfer apparatus 3, and the rotation and reset operation of the mounters 24 and 34 are controlled by the control apparatus 4.

Figure 7:
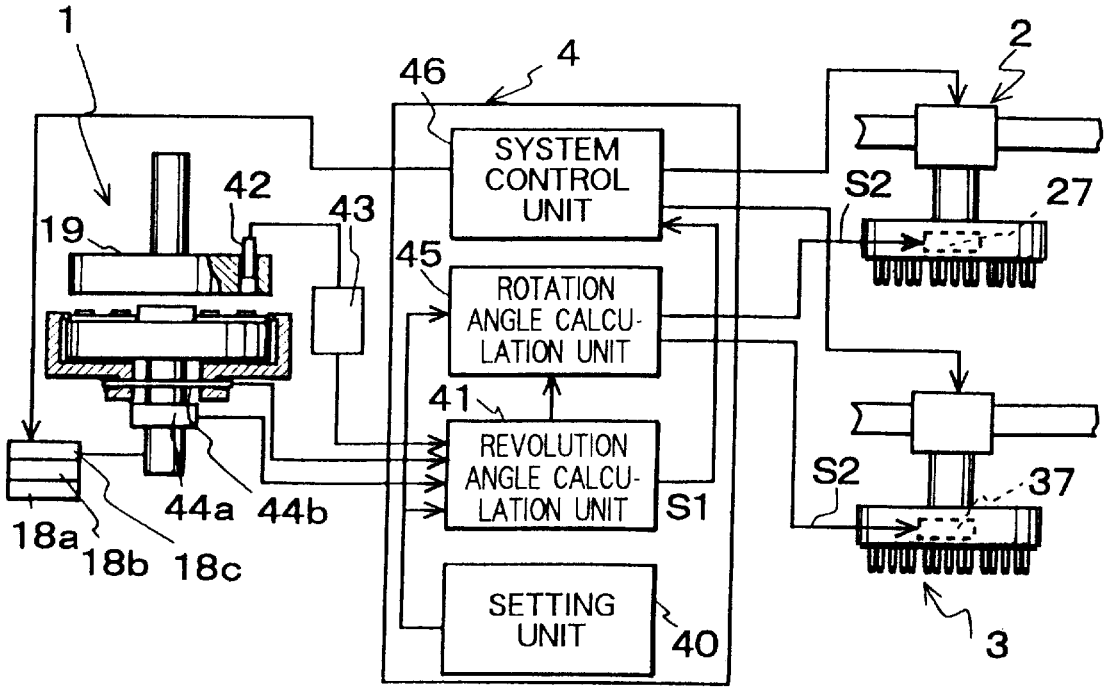
FIG. 7 is a block diagram of a control apparatus.

FIG. 7 is a block diagram of the control apparatus 4.

As shown in FIG. 7, the control apparatus 4 is provided with a setting unit 40, a revolution angle calculation unit 41, a rotation angle calculation unit 45, and a system control unit 46.

The setting unit 40 is the portion in which the operator inputs the number of teeth of the sun gear 12, internal gear 13, and carriers 14 of the polishing apparatus 1, the number of teeth of the gear units 24*c* (gear units 34*c*) and gear unit 26 (gear unit 36) of the first transfer apparatus 2 (second transfer apparatus 3), the number of carriers 14, the number of holding holes 15 of the carriers 14, and the rotational speeds of the sun gear 12 and the internal gear 13.

The revolution angle calculation unit 41 is the portion for finding the revolution angle of the carriers 14 at the time when the workpieces W being polished by the polishing apparatus 1 reach the desired thickness based on the rotation angles of the sun gear 12 and the internal gear 13 at that time.

Specifically, a measurement device 43 calculates the thickness of the workpieces W based on electrical signals from an eddy current sensor or other thickness detecting sensor 42 mounted on the upper platen 19 of the polishing apparatus 1. The revolution angle calculation unit 41 monitors the value of the thickness input from the measurement device 43 and monitors the detection signals from a rotation angle sensor 44*a* of the sun gear 12 and a rotation angle sensor 44*b* of the internal gear 13.

Further, the unit 41 finds the revolution angle R of the carriers 14 based on the following equation (1) from the rotation angle A of the sun gear and the rotation angle B of the internal gear 13 when the value of thickness from the measurement device 43 reaches the desired value. Note that Zs, Zin, and Zc are the numbers of teeth set of the sun gear 12, the internal gear 13, and the carriers 14. A and B are the rotation angles of the sun gear 12 and the internal gear 13.

$$R=(A\cdot Zs+B\cdot Zin)/2(Zs+Zc) \quad (1)$$

Suitably thereafter, the revolution angle calculation unit 41 outputs to the system control unit 46 a correction signal S1 indicating the rotation angles A and B for making the carriers 14 revolve until a revolution angle of a whole multiple of 360°/n closest to the revolution angle R found. This being done, the system control unit 46 controls the motors 18*a* and 18*c* so that the carriers 14 revolve by exactly the angles shown by the correction signal S1, then makes the motors 18*a* to 18*c* stop.

That is, assuming that the workpieces W reach the desired thickness when the for example 10 carriers 14 rotate by exactly 363720° from the start, since the angle of a whole multiple of 360°/n (=360°/10=360°) closest to 363720° is 363960°, the revolution angle calculation unit 41 controls the motors 18*a* and 18*c* so that the carriers 14 rotate by exactly 24° from the current positions.

The rotation angle calculation unit 45 is the portion which finds the rotation angle r of the carriers 14 at the time when the polishing apparatus 1 has been stopped by the above control routine and makes the mounters 24 and 34 of the loader 23 and the unloader 33 rotate at a predetermined timing.

Specifically, it finds the rotation angle r of the carriers 14 using the following equations (2) and (3) based on the revolution angle R at the time of stopping the polishing apparatus 1 (whole multiple of 360°/n) and the rotation angle A of the sun gear 12. Next, it finds the rotation angle C of the gear units 26 and 36 for making the mounters 24 and 34 of the loader 23 and unloader 33 rotate by exactly the rotation angle r and outputs the rotation signal S2 for making the gear units 26 and 36 rotate by exactly the rotation angle C to the motors 27 and 37. Note that Zs' and Zc' are the numbers of teeth of the gear unit 26 (36) and the gear units 24*c* (34*c*) set at the setting unit 40.

$$r=(R-A)\cdot Zs/Zc \quad (2)$$

$$C=r\cdot Zc'/Zs' \quad (3)$$

The system control unit 46 is the portion for controlling the driving and stopping of the polishing operation of the polishing apparatus 1, the transfer operation of the first transfer apparatus 2, and the transfer operation of the second transfer apparatus 3.

Specifically, in FIG. 1, the motors 18*a* to 18*c* are driven in the state where the workpieces W are gripped between the lower platen 10 and the upper platen 19 so as to make the lower platen 10, upper platen 19, sun gear 12, and internal gear 13 rotate.

Further, the system control unit 46, as explained above, controls the motors 18*a* to 18*c* to make the carriers 14 revolve by exactly the angle shown by the correction signal SI then stop when the correction signal S1 is received from the revolution angle calculation unit 41 and controls the upper platen 19 to make it rise.

Suitably thereafter, the system control unit 46 makes the unloader 33 of the second transfer unit 3 move directly above the lower platen 10 of the polishing apparatus 1 and instructs the transmission of the above rotation signal S2 to the rotation angle calculation unit 45 before or when the unloader 33 reaches directly above the lower platen 10. Further, the system control unit 46 performs control so as to make the unloader 33 descend toward the lower platen 10, then make the unloader 33 holding the polished workpieces W by the chucks 35 rise and move to directly above the table 30.

Further, the system control unit 46 stops the supply of power to the motor 37 before or when the unloader 33 reaches directly above the table 30. That is, it performs control to disengage the drive force of the motor 37, then performs control to make the unloader 33 descend toward the table 30. After the unloader 33 places the workpieces W in the receivers 31 of the table 30, it makes it rise directly above the table 30.

Further, the system control unit 46 controls the loader 23 of the first transfer apparatus 2 substantially in parallel to the control of the unloader 33.

That is, it makes the loader 23 descend toward the table 20, then, after the loader 23 holds the unpolished workpieces W, makes it rise and then moves it to directly above the lower platen 10 of the polishing apparatus 1.

Further, it instructs the transmission of a rotation signal S2 to the rotation angle calculation unit 45 before or when the loader 23 reaches directly above the lower platen 10. Next, it makes the loader 23 descend toward the lower platen 10, then, after the loader 23 releases the workpieces W from the chucks 25, makes it rise and makes it move directly above the table 20. The system control unit 46 disengages the drive force of the motor 27 before or when the loader reaches directly above the table 20.

Next, an explanation will be made of the operation by the polishing system of this embodiment. Note that this operation is specifically achieved by the method of control of the polishing system according to a second aspect of the invention.

FIG. 8A to FIG. 8E are views explaining the process of the polishing system. FIG. 9A to FIG. 9E are schematic plan views of the state of rotation and revolution of the carriers 14 and the state of rotation of the mounters 24 (34).

Figure 8A:
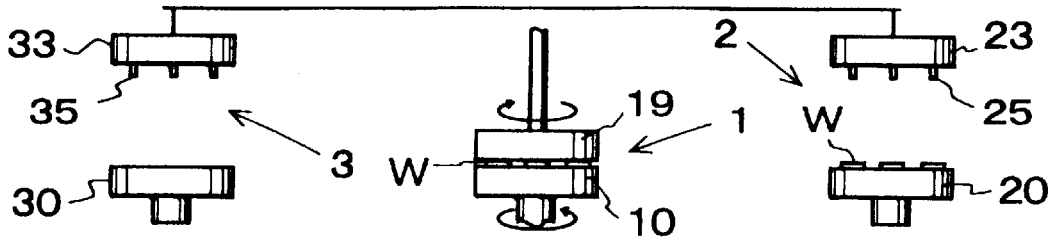
FIG. 8A to FIG. 8E are views explaining the process of the polishing system.
Figure 9A:
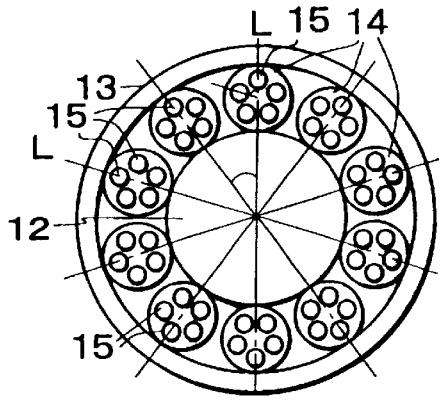
FIG. 9A to FIG. 9E are schematic plan views of the state of rotation and revolution of the carriers and the state of rotation of the mounters.
Figure 9B:
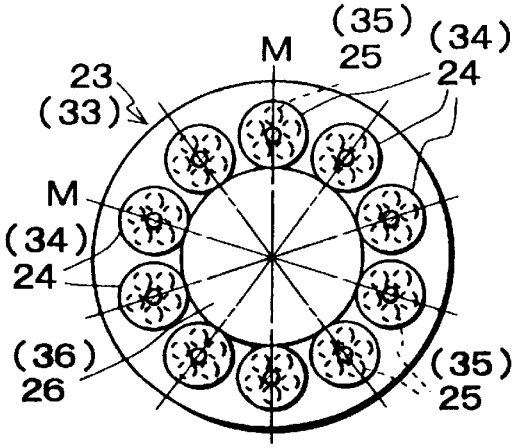

As shown in FIG. 9A and FIG. 9B, the polishing process by the polishing apparatus 1 is executed, as shown in FIG. 8A, from the state where the positions of the carriers 14 and the positions of the mounters 24 completely match (hereinafter referred to as the "initial state").

That is, in the initial state, as shown in FIG. 9A and FIG. 9B, the centers of the n number of carriers 14 lie on the n number of center lines of revolution L at 360°/n intervals matching center lines M of the loader 23 (unloader 33) (hereinafter referred to as the "predetermined revolution position") and, further, the centers of the holding holes 15 positioned at the outermost sides in the m number of holding holes 15 of the carriers 14. Further, in the first transfer apparatus 2 (3) as well, the centers of the chucks 25 (35) positioned at the outermost sides among the m number of chucks 25 (35) of the mounters 24 (34) lie on the center lines M.

If the polishing operation of the polishing apparatus 1 is started from this initial state, as shown in FIG. 8A, the two surfaces of the n×m number of workpieces W held in the holding holes 15 of the rotating and revolving carriers 14 are polished by the lower platen 10 and the upper platen 19 rotating in mutually opposite directions.

The value of the thickness of the workpieces W being polished, as shown in FIG. 7, is monitored by the revolution angle calculation unit 41 of the control apparatus 4 through the thickness detection sensor 42 and the measurement device 43. When the workpieces W are polished to the desired thickness, calculation is performed using the above equation (1) in the revolution angle calculation unit 41 from the rotation angle A of the sun gear 12 and the rotation angle B of the internal gear 13 obtained from the rotation angle sensors 44*a* and 44*b*.

Figure 9C:
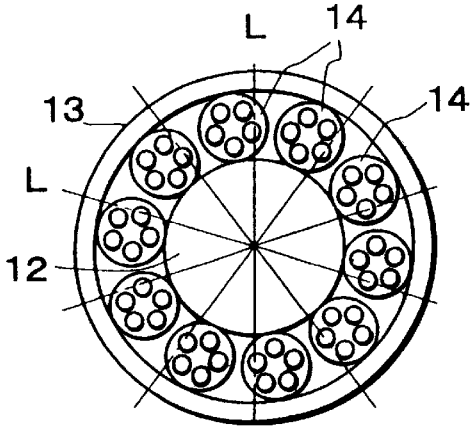

At this time, as shown in FIG. 9C, when the carriers 14 are positioned off from the above predetermined revolution positions, the revolution angle R of the above equation (1) will not be a whole multiple of 360°/n.

Accordingly, in this case, the revolution angle adjustment step is performed.

That is, the angle of the whole multiple of 360°/n closest to the above revolution angle R found is calculated by the revolution angle calculation unit 41 and the correction signal S1 is sent to the system control unit 46.

Figure 9D:
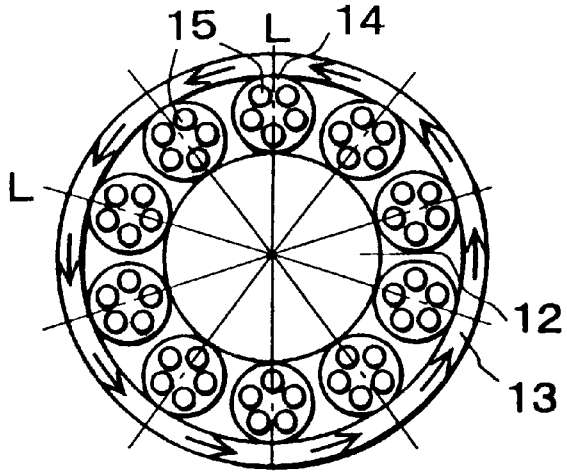

Due to this, the motors 18*a* and 18*c* of the polishing apparatus 1 are controlled by the system control system 46 and, as shown in FIG. 9D, the n number of carriers 14 revolve by exactly an angle smaller than 360°/n. When reaching the predetermined revolution positions, the operation of the polishing apparatus 1 is stopped (end of polishing step).

In this way, according to the polishing system of this embodiment, after the workpieces W reach the desired thickness, the carriers 14 only revolve by an angle smaller than 360°/n while the polishing apparatus 1 is being made to stop, so the rotation angle is also small at that time. Accordingly, the amount of polishing of the workpieces W polished after the desired thickness is reached is also slight and the polishing precision becomes extremely high. The greater the number n of the carriers 14, the more remarkable the effect produced. It is consequently possible to secure a sufficient polishing precision even in a polishing apparatus 1 of a high polishing rate.

The revolution angle adjustment step, however, merely adjusts the n number of carriers 14 to the predetermined revolution positions. It does not return the positions of the m number of holding holes 15 of the carriers 14 to the initial state shown in FIG. 9A. Therefore, in this state, as shown in FIG. 9B and FIG. 9D, the positions of the chucks 25 (35) of the mounters 24 (34) and the positions of the holding holes 15 of the carriers 14 often do not match.

Therefore, a carrier rotation angle determination step where the carriers 14 are not made to rotate, but the mounters 24 (34) are made to rotate to make the chucks 25 (35) match the holding holes 15 in position is performed.

That is, when the revolution angle adjustment step is finished, the rotation angle calculation unit 45 calculates the rotation angle r of the carriers 14 from the above equation (2) using the revolution angle R (whole multiple of 360°/n) when the carriers 14 are stopped, calculates the rotation angle C of the gear units 26 and 36 for making the mounters 24 and 34 of the first transfer apparatus 2 and the second transfer apparatus 3 rotate by exactly the same angle as the rotation angle r from the above equation (3), and thereby determines the rotation signal S2.

Suitably thereafter, the second transfer step is performed.

Figure 8B:
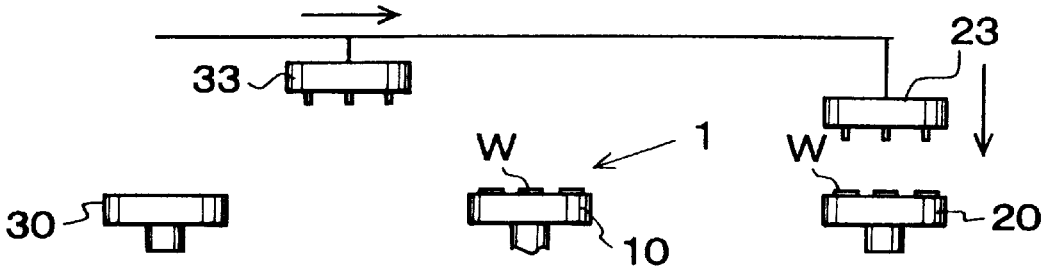

That is, as shown in FIG. 8B, the unloader 33 of the second transfer apparatus 3 is moved to the polishing apparatus 1 side under the control of the system control unit 46. Further, while the unloader 33 is moving or when it reaches directly above the lower platen 10 of the polishing apparatus 1, the rotation signal S2 is sent from the rotation angle calculation unit 45 to the motor 37 of the unloader 33 under the instruction of the system control unit 46, whereby the gear unit 36 of the unloader 33 is rotated by exactly the rotation angle C.

Figure 9E:
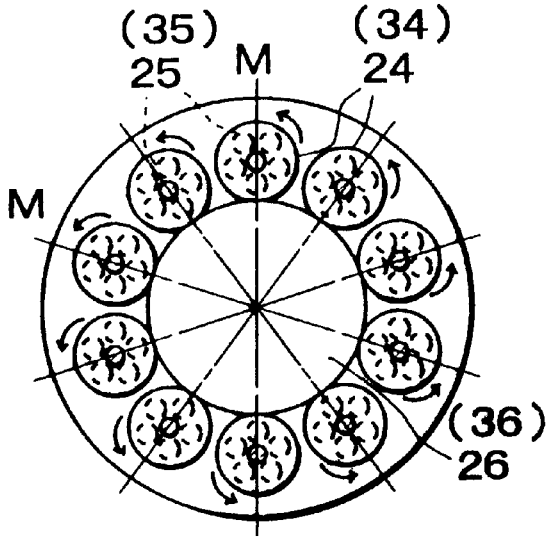
Figure 10:
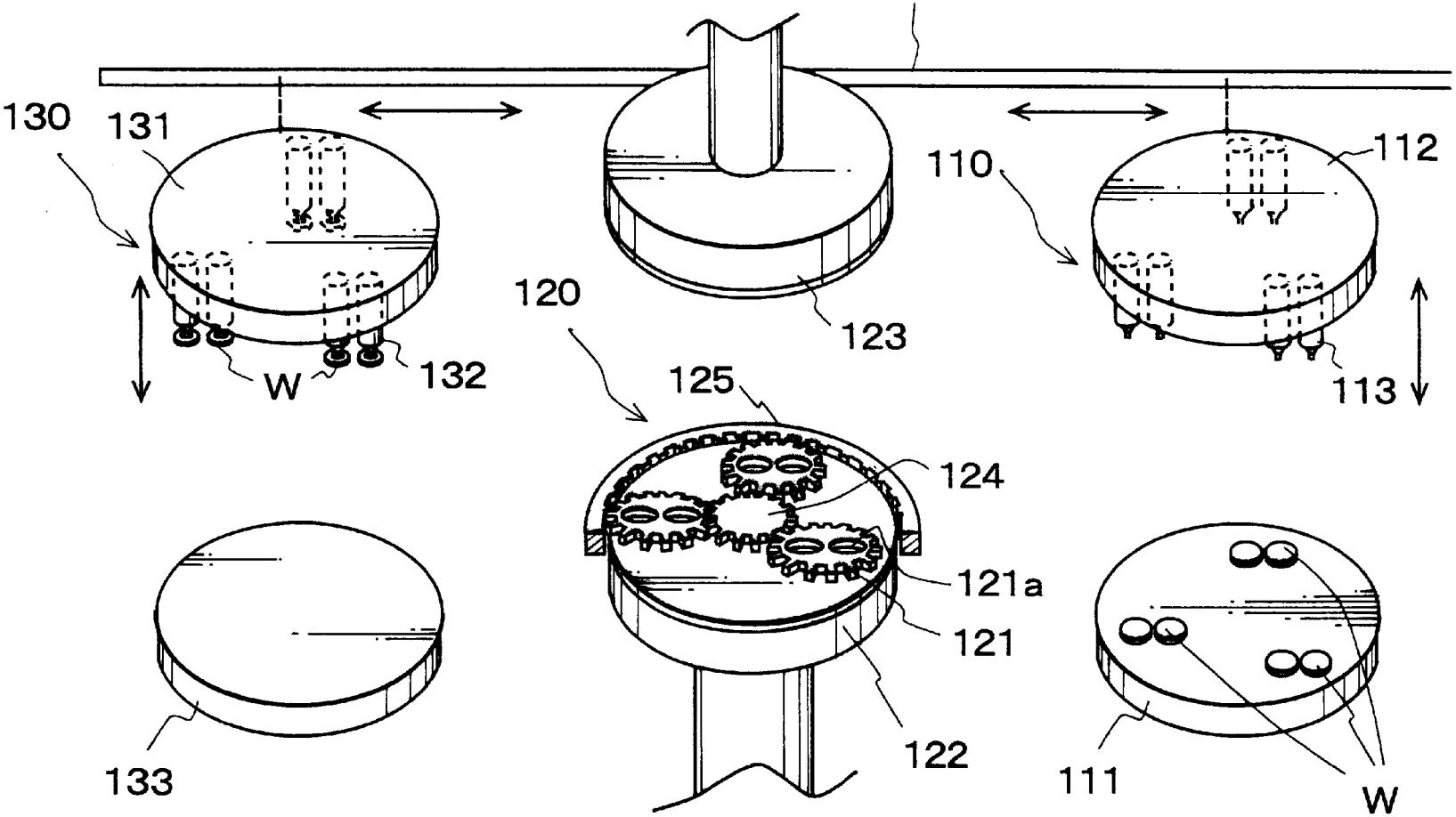
FIG. 10 PRIOR ART
FIG. 10 is a schematic perspective view of a polishing system of the related art.
Figure 11A:
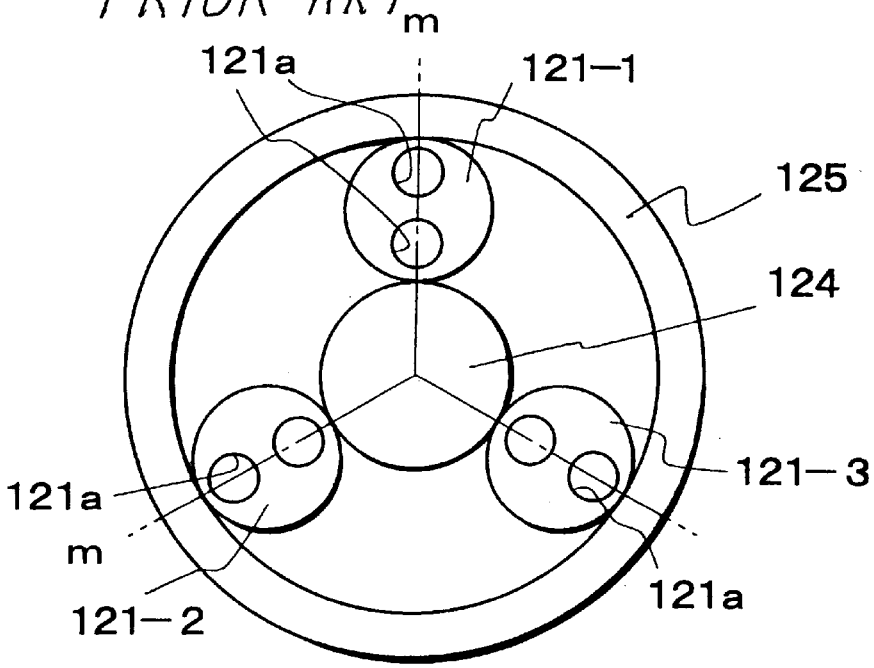
FIG. 11A PRIOR ART
FIG. 11A and FIG. 11B are schematic plan views of the positions of the carriers and holding holes in the polishing system of FIG. 10.
Figure 11B:
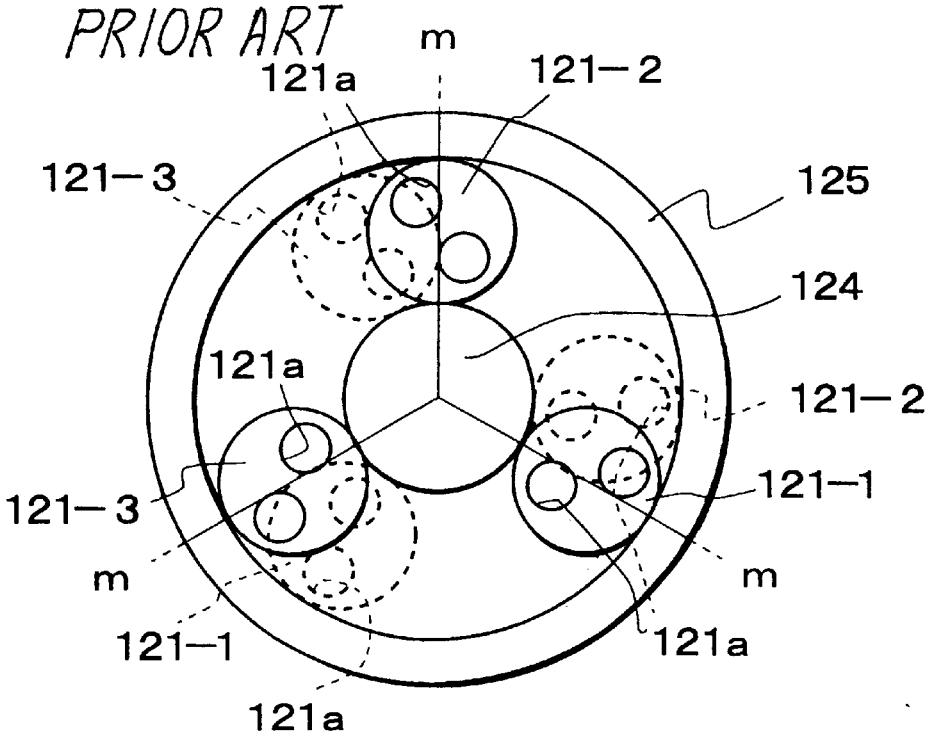
FIG. 11B PRIOR ART

As a result, the mounters 34 rotate all together and, as shown in FIG. 9E, the chucks 35 match with the holding holes shown in FIG. 9D in position.

Figure 8C:
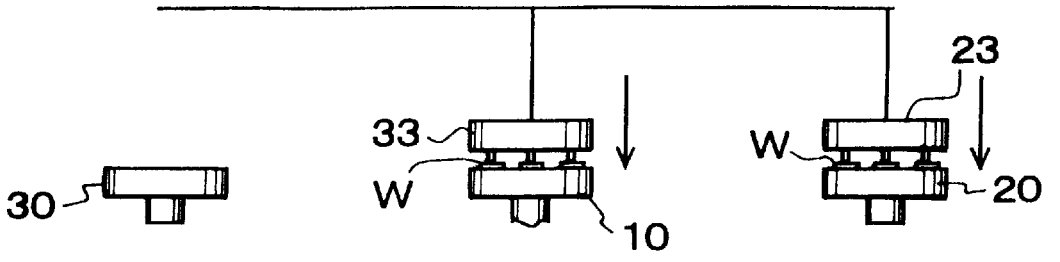

In this state, as shown in FIG. 8C, if the unloader 33 is made to descend toward the lower platen 10 of the polishing apparatus 1, all of the chucks 35 come into contact with the polished workpieces W in a one-to-one correspondence.

Figure 8D:
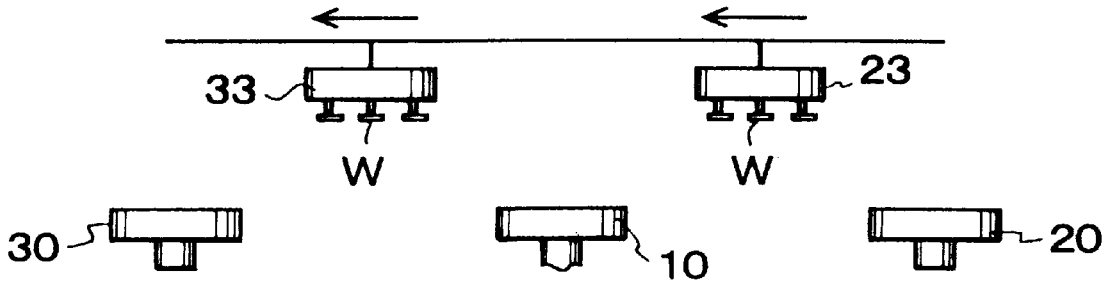

After this, the unloader 33 is made to rise in the state where the chucks 35 hold the workpieces W and can be moved to the table 30 side as shown in FIG. 8D.

Figure 8E:
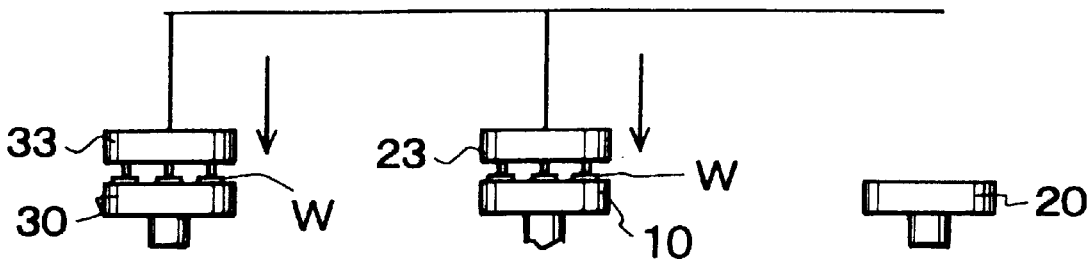

Further, while the unloader 33 is moving or when it reaches directly above the table 30, the drive force of the motor 37 is disengaged under the control of the system control unit 46. The rotation positions of the mounters 34 are reset by the recovery force of the spring 38, then, as shown in FIG. 8E, the unloader 33 descends and the polished workpieces W are placed on the table 30, whereby the second transfer step ends.

The first transfer step is executed substantially in parallel to the second transfer step.

That is, under the control of the system control unit 46, as shown in FIG. 8B and FIG. 8C, the loader 23 of the first transfer apparatus 2 descends toward the table 20 and the workpieces W on the table 20 are held by the chucks 25. The loader 23 then rises, then, as shown in FIG. 8D, is made to move to the polishing apparatus 1 side.

While the loader 23 is moving or when it reaches directly above the lower platen 10 of the polishing apparatus 1, the rotation signal S2 is sent to the motor 27 of the motor 23 and the gear unit 26 of the loader 23 is made to rotate by exactly the rotation angle C.

As a result, the mounters 24 rotate all together and, as shown in FIG. 9E, the chucks 25 are positioned to match the positions of the holding holes 15.

In this state, as shown in FIG. 8E, if the loader 23 is made to descend toward the lower platenn 10, the chucks 25 are positioned corresponding to the empty holding holes 15 on a one-to-one basis. The unpolished workpieces W are placed in the holding holes 15, then the loader 23 is raised and is made to move to the table 20 side.

Further, while the loader 23 is moving or when it reaches directly above the table 20, the rotation positions of the mounters 24 are reset and the first transfer step ends.

After this, the polishing step, revolution angle adjustment step, carrier rotation angle determination step, second transfer step, and first transfer step are repeated in the same way. n×m number of workpieces W are polished at a high precision each time.

EXAMPLE 1

Example 1 shows details of the above embodiment. The number n of the carriers 14 of the polishing apparatus 1 is set to "10", the number m of holding holes 15 of the carriers 14 is set to "5", the numbers of teeth Zs, Zin, and Zc of the sun gear 12, the internal gear 13, and the carriers 14 are set to "1330", "550", and "110", respectively, the number of teeth Zc' of the gear units 24*c* (34*c*) of the first transfer apparatus 2 (second transfer apparatus 3) is set to "110", the number of teeth Zs' of the gear unit 26 (36) is set to "330", the internal gear 13 is fixed in place (B=0), and the sun gear 12 is made to move.

These values are set in advance by the setting unit 40 of the control apparatus 4.

By this configuration, when the motors 18*a* and 18*c* are driven and the polishing apparatus 1 actuated in the state with the internal gear 13 fixed in place, 10×5=50 workpieces W are simultaneously polished.

Further, when the workpieces W are polished to the desired thickness, the revolution angle calculation unit 41 of the control apparatus 4 calculates the revolution angle R of the carriers 14 at that time.

That is, this is calculated by the following equation (4) which is a more specific form of the above equation (1):

$$R=A\cdot Zs/2(Zs+Zc)=3A/8 \tag{4}$$

If the whole multiple of 360°/n=36° closest to the revolution angle R is expressed as 36°·P (P is a whole number), the rotation angle A of the sun gear 12 giving a revolution angle of the carriers 14 of 360°·P is 96°·P. A correction signal S1 showing this rotation angle A is sent to the system control unit 46.

Due to this, the sun gear 12 is rotated until the rotation angle A becomes 96°·P, then the motors 18*a* to 18*c* are stopped.

As a result, if the revolution angle of the carriers 14 when the workpieces W have reached the desired thickness is R1, the carriers 14 are made to revolve by exactly "36°·P-R1" and are positioned at the predetermined revolution positions. The revolution angle is an angle smaller than 36° since the carriers 14 are arranged at 360°/10=36° intervals, so the amount of work on the workpieces W caused during that revolution is slight.

Suitably thereafter, the rotation angle calculation unit 45 finds the rotation angle r of the carriers 14 from the following equation (5) which is a more detailed example of the above equation (2). Note that negative signs mean that the sun gear 12 is made to rotate in a reverse direction.

$$\begin{aligned} r &= (R-A)\cdot Zs/Zc \\ &= 3(R-A) \\ &= 3(36^\circ\cdot P-96^\circ\cdot P) \\ &= -180^\circ\cdot P \end{aligned} \tag{5}$$

As clear from the above equation (5), when the integer P is an odd number, the carriers 14 rotate by exactly 180° from the initial state, while when the integer P is an even number, they may be considered not to rotate.

Therefore, the rotation angle calculation unit 45 makes r 180° when the integer P is an odd number, makes r0° when it is an even number, performs calculation using the following equation (6) which is a more detailed example of the above equation (3), and outputs a rotation signal S2 indicating the rotation angle C of the gear unit 26 (36) to the motor 27 (37) of the loader 23 (unloader 33).

$$C=r/3 \tag{6}$$

In this way, according to this example, since the revolution angle after the workpieces W become the desired thickness is smaller than 36°, there is little amount of wasted polishing occurring during that time and as a result it is possible to achieve a high precision of polishing.

The rest of the configuration, action, and advantageous effects are the same as those of the above embodiment, so will not be explained further.

EXAMPLE 2

Example 2 differs from the above Example 1 in the point that the sun gear 12 is fixed in place and the internal gear 13 is driven.

Due to this, when the workpieces W are polished to the desired thickness, calculation is performed using the following equation (7) which is a more detailed example of the above equation (1) at the revolution angle calculation unit 41:

$$R=B\cdot Zin/2(Zs+Zc)=5B/8 \tag{7}$$

The rotation angle B of the internal gear 13 for making the carriers 14 revolve to the revolution angle 36°·P closest to the revolution angle R is "57.6°·P", so the correction signal S1 indicating this rotation angle B is sent to the system control unit 46, the motors 18*a* to 18*c* are stopped, and the carriers 14 are positioned at the predetermined revolution positions.

At this time as well, the revolution angle of the carriers 14 is smaller than 36°.

Suitably thereafter, the rotation calculation unit 45 finds the rotation angle r of the carriers 14 from the following equation (8) which is a more detailed example of the above equation (2):

$$\begin{aligned} r &= R^\circ \cdot Zs/Zc \\ &= 3R \\ &= 108^\circ \cdot P \end{aligned} \tag{8}$$

Equation (8) may be modified as shown in the following equation (9). However, Q is an integer (≧0) and r' is the remainder (0≧r'<360°).

$$r=360^\circ\cdot Q+r' \tag{9}$$

Therefore, the rotation calculation unit 45 divides the "108°·P" found by the above equation (8) by 360°, finds the remainder r', regards r' as the rotation angle r of the carriers 14 to perform calculation using the above equation (6), and outputs the rotation signal S2 indicating this rotation angle C to the motor 27 (37) of the loader 23 (unloader 33).

The rest of the configuration, action, and advantageous effects are the same as those of the above Example 1, so will not be explained further.

EXAMPLE 3

Example 3 differs from the above Example 1 and Example 2 in the point that the rotational speeds of the sun gear 12 and the internal gear 13 are controlled so that the carriers 14 do not revolve, but continue to rotate at the predetermined positions.

That is, the setting unit 40 of the control apparatus 4 sets R to 0, so the revolution angle calculation unit 41 performs a calculation using the following equation (10) which is a more detailed example of the above equation (1):

$$0=(A\cdot Zs+B\cdot Zin)/2(Zs+Zc)=(3A+5B)/8 \tag{10}$$

The system control unit 46 controls the motor 18*a* and the motor 18*c* based on the result of the above calculation in the revolution angle calculation unit 41 so that the sun gear 12 and the internal gear 13 are made to rotate in opposite directions and by the rotational ratio shown in the following equation (11):

$$A/B=-5/3 \tag{11}$$

Further, when the workpieces W are polished to the desired thickness, the revolution angle R of the carriers 14 is found from the rotational speeds A and B of the sun gear 12 and the internal gear 13 at that time based on the above equation (10).

At that time, since the revolution angle R is always "0" and always matches 36°·P, a correction signal S1 indicating the rotational speeds A and B of the sun gear 12 and the internal gear 13 at that point of time is sent to the system control unit 46 and the motors 18*a* to 18*c* are made to stop at that time.

Suitably thereafter, the rotation calculation unit 45 finds the rotation angle r of the carriers 14 from the following equation (12) which is a more detailed example of the above equation (2) based on the rotational speeds A and B of the sun gear 12 and the internal gear 13 at that time:

$$\begin{aligned} r &= A\cdot Zs/Zc \\ &= -3A \end{aligned} \tag{12}$$

Equation (12) may also be modified as shown in the above equation (9), so the rotation calculation unit 45 divides the "−3A" found by the above equation (12) by 360°, finds the remainder r', regards r' as r to perform calculation using the above equation (6), and outputs the rotation signal S2 indicating this rotation angle C to the motor 27 (37) of the loader 23 (unloader 33).

In this way, since this example is configured so that the polishing apparatus 1 is made to stop immediately when the workpieces W are polished to the desired thickness, there is no subsequent wasted polishing at all and a high precision of polishing becomes possible.

The rest of the configuration, action, and advantageous effects are the same as those of the above Example 1 and Example 2, so will not be explained further.

EXAMPLE 4

Example 4 differs from the above Example 1 to Example 3 in the point that the rotational speeds of the sun gear 12 and the internal gear 13 are controlled so that the carriers 14 revolve in the same direction as the sun gear 12.

That is, the revolution angle calculation unit 41 of the control apparatus 4 performs calculation using the following equation (13) which is a more detailed example of the above equation (1) and derives the following equation (14):

$$R=(A\cdot Zs+B\cdot Zin)/2(Zs+Zc)=(3A+5B)/8 \tag{13}$$

$$A/B>-5/3 \quad (14)$$

Due to this, the system control unit 46 controls the motors 18*a* and 18*c* based on the results of the calculation at the revolution angle calculation unit 41 so that the sun gear 12 and the internal gear 13 are made to rotate in opposite directions and by a rotation ratio larger than 5/3.

Further, when the workpieces W are polished to a desired thickness, calculation is performed using the above equation (13) to find the revolution angle R of the carriers at that time, a correction signal S1 indicating the rotational speeds A and B of the sun gear 12 and internal gear 13 for making the carriers 14 revolve to the 360°·P closest to the revolution angle R is sent to the system control unit 46, and the carriers 14 are positioned at the predetermined revolution positions.

Suitably thereafter, the rotation calculation unit 45 finds the rotation angle r of the carriers 14 from the following equation (15) which is a more detailed example of the above equation (2). Here, however, "A" is the revolution angle of the sun gear 12 when making the carriers 14 revolve to 360°·P.

$$\begin{aligned} r &= (R-A)\cdot Zs/Zc \quad (15) \\ &= 3(R-A) \\ &= 3(36^\circ\cdot P-A) \end{aligned}$$

Equation (15) may also be modified as shown in the above equation (9), so the rotation calculation unit 45 divides the rotation angle at the right side of equation (15) by 360°, finds the remainder r', regards r' as r to perform calculation using the above equation (6), and outputs the rotation signal S2 indicating this rotation angle C to the motor 27 (37) of the loader 23 (unloader 33).

The rest of the configuration, action, and advantageous effects are the same as those of the above Example 1 to Example 3, so will not be explained further.

EXAMPLE 5

Example 5 differs from the above Example 4 in the point that the rotational speeds of the sun gear 12 and the internal gear 13 are controlled so that the carriers 14 revolve in the opposite direction to the sun gear 12.

That is, the revolution angle calculation unit 41 of the control apparatus 4 performs calculation using the above equation (13) under the condition R<0 and derives the following equation (16):

$$A/B<-5/3 \quad (16)$$

Due to this, the system control unit 46 controls the motors 18*a* and 18*c* so that the sun gear 12 and the internal gear 13 are made to rotate in opposite directions and by a rotation ratio smaller than 5/3.

The rest of the configuration, action, and advantageous effects are the same as those of the above Example 4, so will not be explained further.

Note that the present invention is not limited to the above embodiment and may be modified in various ways within the scope of the gist of the invention.

For example, in the above embodiment, the gear units 24*c* (34*c*) and the gear unit 26 (36) comprising the rotating mechanism of the first transfer apparatus 2 (second transfer apparatus 3) were directly connected, but it is also possible to provide one or more idle gears between the gear units 24*c* (34*c*) and the gear unit 26 (36) and transmit the rotation of the gear unit 26 (36) to the gear units 24*c* (34*c*). Further, it is also possible to connect the gear units 24*c* (34*c*) and the gear unit 26 (36) by an endless chain.

Further, in the above embodiment, a gear mechanism was used as the rotating mechanism, but it is also possible to make it a belt mechanism, make the gear units 24*c* (34*c*) and the gear unit 26 (36) pulleys, and connect these by an endless belt without substantially no slip.

Further, in the above embodiment, the revolution angle calculation unit 41 calculated the revolution angle R of the carrier 14 at the time when the workpieces W reached the desired thickness by the above equation (1), output a correction signal S1 for making the carriers 14 revolve to a revolution angle of a whole multiple of 360°/n closest to the revolution angle R to the system control unit 46, and controlled the motors 18*a* and 18*c* by the system control unit 46, but the invention is not limited to this. It may also be structured to control the system in the following way.

That is, when the value of the thickness of the workpieces W indicated by the signal from the measurement device 43 reaches a desired thickness, the signal is output from the revolution angle calculation unit 41 to the system control unit 46. Receiving this signal, the system control unit 46 controls the motors 18*a* and 18*c* to slow down the rotational speeds of the sun gear 12 and the internal gear 13. Suitably thereafter, the revolution angle calculation unit 41 applies the rotational speeds A and B from the rotational speed sensors 44*a* and 44*b* to the right side of the above equation (1). When the left side becomes an angle of a whole multiple of 360°/n, a stopping signal is sent from the revolution angle calculation unit 41 is sent to the system control unit 46. Further, when the system control unit 46 receives the stopping signal, the motors 18 to 18*c* are made to stop.

As explained in detail above, according to the present invention, since the angle by which the carriers are made to revolve is smaller than 360°/n up until the polishing operation is stopped after the workpieces reach the desired thickness, there is extremely little wasted polishing during that period and as a result a high precision of polishing of the workpieces becomes possible. In particular, the larger the number of carriers, the more conspicuous the effect. Consequently, a sufficient polishing performance can be secured even in a polishing unit having a high polishing rate. Further, since it is possible to reduce the wasted polishing work time after the workpieces reach the desired thickness, the operating rate of the system can be improved and as a result high precision workpieces can be mass produced at a fast speed.

We claim:

1. A polishing system comprising:

a polishing unit having a rotatable lower platen, a sun gear able to rotate about a center of the lower platen, a rotatable internal gear arranged concentrically at the outside of the sun gear, n number of carriers having around the center thereof m number of holding holes formed at 360°/m intervals and arranged around the center of the sun gear at 360°/n intervals in a state engaged with said sun gear and internal gear, and an upper platen able to rotate in an opposite direction to the lower platen in a state gripping workpieces in the holding holes of the carriers together with the lower platen;

a first transfer unit having a loader movable at the polishing unit side, n number of mounters provided on the loader in an array corresponding to the n number of carriers and able to rotate, m number of chucks mounted on said mounters in an array corresponding to the m number of holding holes, and a rotating mechanism provided on the loader and enabling said n number of mounters to rotate all together, the first transfer unit picking up the unpolished workpieces by the chucks and transferring them into the holding holes formed in the carriers of the polishing unit;

a second transfer unit having an unloader movable from the polishing unit side, n number of mounters provided on the unloader in an array corresponding to the n number of carriers and able to rotate, m number of chucks mounted on said mounters in an array corresponding to the m number of holding holes, and a rotating mechanism provided on the unloader and enabling said n number of mounters to rotate all together, the second transfer unit taking out the polished workpieces by the chucks from the holding holes of the carriers and transferring them to a predetermined location; and a control unit making the carriers revolve to a revolution angle of a whole multiple of 360°/n closest to a revolution angle of the carriers and stopping the polishing unit at the time when the workpieces become the desired thickness, finding a rotation angle of the carriers at the stopped position, and controlling the rotating mechanisms of the loader and unloader to make the mounters of the loader and unloader rotate by exactly that rotation angle.

2. A polishing system as set forth in claim 1, wherein:

when the rotation angles of the sun gear and internal gear are A and B and the numbers of teeth of the sun gear, internal gear, and carriers are Zs, Zin, and Zc, based on the two equations $$R=(A\cdot Zs+B\cdot Zin)/2(Zs+Zc) \text{ and}$$

$$r=(R-A)\cdot Zs/Zc$$

the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

3. A polishing system as set forth in claim 2, wherein:

the polishing unit makes the sun gear rotate in a state where the internal gear is stopped and, based on the two equations $$R=A\cdot Zs/2(Zs+Zc) \text{ and}$$

$$r=(R-A)\cdot Zs/Zc$$

the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

4. A polishing system as set forth in claim 2, wherein:

the polishing unit makes the internal gear rotate in a state where the sun gear is stopped and, based on the two equations $$R=B\cdot Zin/2(Zs+Zc) \text{ and}$$

$$r=R\cdot Zs/Zc$$

the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

5. A polishing system as set forth in claim 2, wherein:

the polishing unit makes the sun gear and the internal gear rotate so that the carriers rotate to a predetermined position and, based on the two equations $$0=(A\cdot Zs+B\cdot Zin)/2(Zs+Zc) \text{ and}$$

$$r=A\cdot Zs/Zc$$

the control unit calculates the rotation angle r of the carriers at a predetermined position and makes the mounters of the loader and unloader rotate by exactly the calculated rotation angle r of the carriers.

6. A polishing system as set forth in claim 2, wherein:

the polishing unit makes the sun gear and the internal gear rotate so that the revolution direction of the carriers becomes the same direction as the rotation direction of the sun gear and, under the condition R>0 and based on the two equations, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

7. A polishing system as set forth in claim 2, wherein:

the polishing unit makes the sun gear and the internal gear rotate so that the revolution direction of the carriers becomes the opposite direction as the rotation direction of the sun gear and, under the condition R<0 and based on the two equations, the control unit makes the carriers revolve until a revolution angle of a whole multiple of 360°/n closest to the revolution angle of the carriers when the workpieces have reached the desired thickness, then stops them, calculates the rotation angle r of the carriers at that stopped position, and makes the mounters of the loader and unloader rotate by exactly the calculated rotation angle r of the carriers.

8. A polishing system as set forth in claim 1, wherein:

the rotating mechanisms of the loader and unloader are comprised of gear mechanisms.

9. A polishing system as set forth in claim 8, wherein:

each of the gear mechanisms is comprised of a first gear unit provided at each of the n number of mounters, a second gear unit for making the first gear units rotate all together, and a drive unit for making the second gear unit rotate and the control unit controls the drive unit to make the n number of mounters rotate by exactly the rotation angle of the carriers.

10. A polishing system as set forth in claim 9, wherein:

the second gear unit is made to engage with all of the n number of first gear units.

11. A polishing system as set forth in claim 9, wherein:

an idle gear is interposed between the n number of first gear units and the second gear unit.

12. A polishing system as set forth in claim 9, wherein:

an endless chain is wound between each of the n number of first gear units and the second gear unit.

13. A polishing system as set forth in claim 1, wherein:

the rotating mechanisms of the loader and the unloader are comprised of belt mechanisms.

14. A polishing system as set forth in claim 13, wherein:

each of the belt mechanisms wind an endless belt between each of the shafts of the n number of mounters and a shaft of the drive unit and the control unit controls the drive unit to make the n number of mounters rotate by exactly the rotation angle of the carriers.

15. A method of controlling a polishing system comprising:

a polishing step for making at least one of a sun gear and an internal gear rotate, making n number of carriers arranged around the center of the sun gear at 360°/n intervals revolve while rotating in a state where the sun gear and the internal gear are engaged, and polishing two surfaces of workpieces held in m number of holding holes formed around the centers of the carriers at 360°/m intervals by an upper platen and lower platen rotating in mutually opposite directions;

a carrier revolution angle adjustment step for making the carriers revolve until a revolution angle of a whole multiple of 360°/n closest to a revolution angle of the carriers when the workpieces reach a desired thickness, then making the rotation and revolution operation of the carriers stop;

a carrier rotation determination step for finding a rotation angle of the carriers at the stopped position;

a second transfer step for making n number of mounters provided on an unloader in an array corresponding to the n number of carriers, able to rotate, and having m number of chucks mounted on said mounters in an array corresponding to the m number of holding holes rotate by exactly the rotation angle of the carriers found in said carrier rotation angle determination step so that the chucks are positioned substantially matching the positions of the polished workpieces, picking up the polished workpieces by these chucks, and transferring them out from the carriers; and a first transfer step for making n number of mounters provided on a loader in an array corresponding to the n number of carriers, able to rotate, and having m number of chucks mounted on said mounters in an array corresponding to the m number of holding holes rotate by exactly the rotation angle of the carriers found in said carrier rotation angle determination step so that the chucks are positioned substantially matching the positions of the polished workpieces, and transferring unpolished workpieces picked up by these chucks into the holding holes.

16. A method of control of a polishing system as set forth in claim 15, wherein:

the carrier revolution adjustment step and the carrier rotation angle determination step calculate a revolution angle R and a rotation angle r of the carriers at the stopped position from the two equations $$R=(A\cdot Zs+B\cdot Zin)/2(Zs+Zc) \text{ and}$$

$$r=(R-A)\cdot Zs/Zc$$

where the rotation angles of the sun gear and internal gear are A and B and the numbers of teeth of the sun gear, internal gear, and carriers are Zs, Zin, and Zc.

17. A method of control of a polishing system as set forth in claim 16, wherein:

the polishing step makes the sun gear rotate in a state where the internal gear is stopped and the carrier revolution adjustment step and the carrier rotation determination step calculate a revolution angle R and a rotation angle r of the carriers at the stopped position based on the two equations $$R=A\cdot Zs/2(Zs+Zc) \text{ and}$$

$$r=(R-A)\cdot Zs/Zc.$$

18. A method of control of a polishing system as set forth in claim 16, wherein:

the polishing step makes the internal gear rotate in a state where the sun gear is stopped and the carrier revolution adjustment step and the carrier rotation determination step calculate a revolution angle R and a rotation angle r of the carriers at the stopped position based on the two equations $$R=B\cdot Zin/2(Zs+Zc) \text{ and}$$

$$r=R\cdot Zs/Zc.$$

19. A method of control of a polishing system as set forth in claim 16, wherein:

the polishing step makes the sun gear and the internal gear rotate so that the carriers rotate to a predetermined position and the carrier rotation determination step calculate a rotation angle r of the carriers at the stopped position based on the two equations $$0=(A\cdot Zs+B\cdot Zin)/2(Zs+Zc) \text{ and}$$

$$r=A\cdot Zs/Zc.$$

20. A method of control of a polishing system as set forth in claim 16, wherein:

the polishing step makes the sun gear and the internal gear rotate so that the revolution direction of the carriers becomes the same direction as the rotation direction of the sun gear and the carrier revolution adjustment step and the carrier rotation determination step calculate a revolution angle R and a rotation angle r of the carriers at the stopped position based on the two equations under the condition of R>0.

21. A method of control of a polishing system as set forth in claim 16, wherein:

the polishing step makes the sun gear and the internal gear rotate so that the revolution direction of the carriers becomes the opposite direction as the rotation direction of the sun gear and the carrier revolution adjustment step and the carrier rotation determination step calculate a revolution angle R and a rotation angle r of the carriers at the stopped position based on the two equations under the condition of R>0.

* * * * *